US010352322B2

(12) United States Patent
Andersen et al.

(10) Patent No.: US 10,352,322 B2
(45) Date of Patent: Jul. 16, 2019

(54) VANE CELL MACHINE WITH CENTRIC BORE IN RING INSERT IN SIDE WALL

(71) Applicant: Danfoss A/S, Nordborg (DK)

(72) Inventors: Stig Kildegaard Andersen, Krusaa (DK); Poul Erik Hansen, Aabenraa (DK); Erik Haugaard, Graasten (DK)

(73) Assignee: Danfoss A/S, Nordborg (DK)

( * ) Notice: Subject to any disclaimer, the term of this patent is extended or adjusted under 35 U.S.C. 154(b) by 219 days.

(21) Appl. No.: 15/187,899

(22) Filed: Jun. 21, 2016

(65) Prior Publication Data

US 2016/0377080 A1 Dec. 29, 2016

(30) Foreign Application Priority Data

Jun. 26, 2015 (EP) ..... 15174073

(51) Int. Cl.

| | |
|---|---|
| ***F04C 15/00*** | (2006.01) |
| ***F01C 21/10*** | (2006.01) |
| ***F04C 18/32*** | (2006.01) |
| ***F04C 2/344*** | (2006.01) |

(52) U.S. Cl.

CPC ..... *F04C 15/0023* (2013.01); *F01C 21/108* (2013.01); *F04C 2/3442* (2013.01); *F04C 18/32* (2013.01)

(58) Field of Classification Search

CPC ..... F04C 15/0023

See application file for complete search history.

(56) References Cited

U.S. PATENT DOCUMENTS

| | | | | |
|---|---|---|---|---|
| 2,747,843 | A | 5/1956 | Cox et al. | |
| 3,256,831 | A * | 6/1966 | Eickmann | F04C 15/0023 277/357 |
| 3,507,584 | A | 4/1970 | Robbins | |
| 3,582,241 | A | 6/1971 | Niemiec et al. | |
| 3,926,095 | A | 12/1975 | Weigle | |
| 3,947,046 | A | 3/1976 | Maruyama et al. | |
| 5,180,173 | A | 1/1993 | Kimura et al. | |

(Continued)

FOREIGN PATENT DOCUMENTS

| | | |
|---|---|---|
| CN | 2729318 Y | 9/2005 |
| CN | 102072149 A | 5/2011 |

(Continued)

OTHER PUBLICATIONS

European Search Report for European Application No. EP 15174079 dated Jan. 12, 2016.

(Continued)

*Primary Examiner* — Mary Davis

(74) *Attorney, Agent, or Firm* — McCormick, Paulding & Huber LLP

(57) ABSTRACT

A vane cell machine (1) is described comprising a stator (2) and a rotor (3), said rotor (3) having radially displaceable vanes (4) bearing on an inside (5) of the stator (2) and bordering, together with the rotor (3), the stator (2), and a side wall (7) at each axial end of the rotor (3), work chambers (6) the volume of which changes during a rotation of said rotor, at least one side wall (7) bearing an insert in form of a ring (9). Such a machine should be of simple construction. To this end, said ring (9) comprises a centric bore (10).

19 Claims, 1 Drawing Sheet

(56) References Cited

U.S. PATENT DOCUMENTS

| | | | | |
|---|---|---|---|---|
| 5,536,153 | A * | 7/1996 | Edwards | F01C 21/0809 418/89 |
| 5,571,268 | A | 11/1996 | Azibert | |
| 5,833,438 | A * | 11/1998 | Sundberg | F04C 15/0023 417/204 |
| 5,944,498 | A | 8/1999 | Wupper et al. | |
| 6,142,478 | A | 11/2000 | Pecht et al. | |
| 6,280,150 | B1 * | 8/2001 | Miyazawa | F04C 15/0023 417/220 |
| 8,387,558 | B2 | 3/2013 | Herre et al. | |
| 9,328,743 | B2 | 5/2016 | Hirosawa et al. | |
| 9,546,671 | B2 | 1/2017 | Hirosawa et al. | |
| 9,617,994 | B2 * | 4/2017 | Walters | F04C 15/0023 |
| 9,945,216 | B2 | 4/2018 | Ghasripoor et al. | |
| 2003/0015840 | A1 | 1/2003 | Davis | |
| 2012/0043725 | A1 | 2/2012 | Jahn et al. | |
| 2013/0108498 | A1 | 5/2013 | Petersen et al. | |
| 2013/0108499 | A1 | 5/2013 | Petersen et al. | |
| 2014/0234150 | A1 | 8/2014 | Sugihara et al. | |
| 2015/0300352 | A1 | 10/2015 | Walters et al. | |

FOREIGN PATENT DOCUMENTS

| | | | |
|---|---|---|---|
| CN | 103075339 | A | 5/2013 |
| CN | 103562568 | A | 2/2014 |
| CN | 203532360 | U | 4/2014 |
| CN | 203641136 | U | 6/2014 |
| DE | 10 2005 056 909 | A1 | 5/2007 |
| EP | 2 495 441 | A1 | 9/2012 |
| EP | 2 662 565 | A1 | 11/2013 |
| GB | 1 378 627 | A | 12/1974 |
| GB | 2 032 010 | A | 4/1980 |
| JP | S62-178781 | A | 8/1987 |
| JP | 2006097497 | A | 4/2006 |
| JP | 2010-190383 | A | 9/2010 |
| WO | 2012/045995 | A2 | 4/2012 |
| WO | 2014/003626 | A1 | 1/2014 |

OTHER PUBLICATIONS

European Search Report for European Application No. EP15174081 dated Jan. 12, 2016.

* cited by examiner

VANE CELL MACHINE WITH CENTRIC BORE IN RING INSERT IN SIDE WALL

CROSS REFERENCE TO RELATED APPLICATION

Applicant hereby claims foreign priority benefits under U.S.C. § 119 from European Patent Application No. 15174073 filed on Jun. 26, 2015, the content of which is incorporated by reference herein.

TECHNICAL FIELD

The present invention relates to a vane cell machine comprising a stator and a rotor, said rotor having radially displaceable vanes bearing on an inside of the stator and bordering, together with the rotor, the stator and a side wall at each axial end of the rotor, work chambers the volume of which changes during a rotation of said rotor, at least one side wall bearing an insert in form of a ring.

BACKGROUND

Such a vane cell machine is known, for example, from US 2013/0108498 A1.

During a rotation of the rotor, the work chambers have to increase and to decrease their volumes. To this end, it is known to position the rotor eccentrically in a bore of the stator. The work chambers have the smallest volume in a region in which a distance between an axis of the rotor and the inside of the stator is smallest. In the above mentioned US 2013/0108498 A1 the ring is positioned centrically with respect to the bore of the stator and has an eccentric bore accommodating an axle of the rotor. The ring can serve as axial bearing for the rotor.

However, the use of an asymmetric ring, i.e. a ring with an eccentrical hole for the rotor, makes mounting of the machine complicated since the ring has to be mounted with an exact angular position within the side wall of the stator. The asymmetry also causes unwanted forces from pressure to act on the ring.

SUMMARY

The object of the present invention is to provide a simple construction of the vane cell machine.

With a vane cell machine as mentioned in the introduction, this task is solved in that said ring comprises a centric bore.

The ring now is symmetric in all angular orientations. This facilitates the mounting of the ring in the side wall. This ring can be used for a number of functions. A first function is a sealing function. A second function is an axial bearing. Finally, the ring can be used to keep leakages at a minimum.

In a preferred embodiment an auxiliary element is located radially outside said ring and extends no more than 180° in circumferential direction of said ring. This auxiliary element now replaces the eccentricity of the previous used asymmetric ring. This auxiliary element can be used as well as axial bearing and as a means to keep leakages low. However, it is no longer necessary that the auxiliary element is used for sealing.

Preferably, said auxiliary element comprises a width in radial direction of said rotor decreasing in circumferential direction starting from a central part. The auxiliary element has the form of a sickle or of a crescent moon, so that the ends of the auxiliary element in circumferential direction have a smaller width. The combination of the symmetric ring and the auxiliary element replaces the previous asymmetric ring.

In a preferred embodiment said auxiliary element has a length in circumferential direction which is greater than a width of said vanes in circumferential direction. Since the vanes are guided in slits or guides provided in the rotor, this construction makes it possible that the rotor can always contact the auxiliary element. The auxiliary element can then be used as axial bearing.

Preferably, said auxiliary element has a length in circumferential direction which is greater than a distance between two vanes in circumferential direction. This has the effect that the auxiliary element overlaps the axial end of a working chamber.

In a preferred embodiment in radial direction said auxiliary element has a predetermined distance to said ring. The ring and the auxiliary element can be mounted separately. They are two distinct elements making mounting of the machine simple.

Preferably, said auxiliary element protrudes out of said side wall. When the rotor contacts the auxiliary element, it does not contact the side wall thereby minimizing wear.

Preferably, said auxiliary element is connected to said side wall. For example, the auxiliary element can be connected to the side wall by means of one or more screws or bolts.

Preferably, a ring channel is located on a side of said ring opposite said rotor, said ring channel being connected to a region in which said work chambers show a high pressure. This has the effect that a pressure in the ring channel corresponds to the high pressure of the work chambers. This high pressure acts on the ring in a direction pressing the ring against the rotor. Since the pressing forces depend on the pressure in the high pressure area of the work chambers, there can be adjusted an equilibrium keeping wear as small as possible.

Preferably, a first sealing ring is located in said ring channel, wherein said first sealing ring generates a force onto said ring in a direction towards said rotor. The first sealing ring is made of an elastomeric material, like an O-ring. The first sealing ring generates a sort of pretension so that starting of the vane cell machine or pressurization of the working fluid in a fluid circuit by means of an external pump is facilitated. During the start period some time is needed to build up the necessary pressure. For example, the side plate should seal to enable pressurization of a part of a reverse osmosis system by means of the vane cell machine used as pump.

Preferably, a second sealing ring is positioned on a circumferential side of said ring. The second sealing ring, which is of an elastic material as well, generates a small spring force acting on the ring and centers it in the bore of the side wall. Furthermore, it is preferred that the second sealing ring is positioned as close at the rotor as possible, so that a part of the circumference of the ring, which is subject to different pressures, can be kept minimal. An asymmetric load on the ring can be kept small.

Preferably, said rotor comprises a support ring bearing against said ring. One of the ring and of the support ring can be used as wear part, which can easily be replaced if worn.

BRIEF DESCRIPTION OF THE DRAWINGS

In the following, the invention is described on the basis of a preferred embodiment in connection with the drawings, showing.

DETAILED DESCRIPTION

Figure 1:
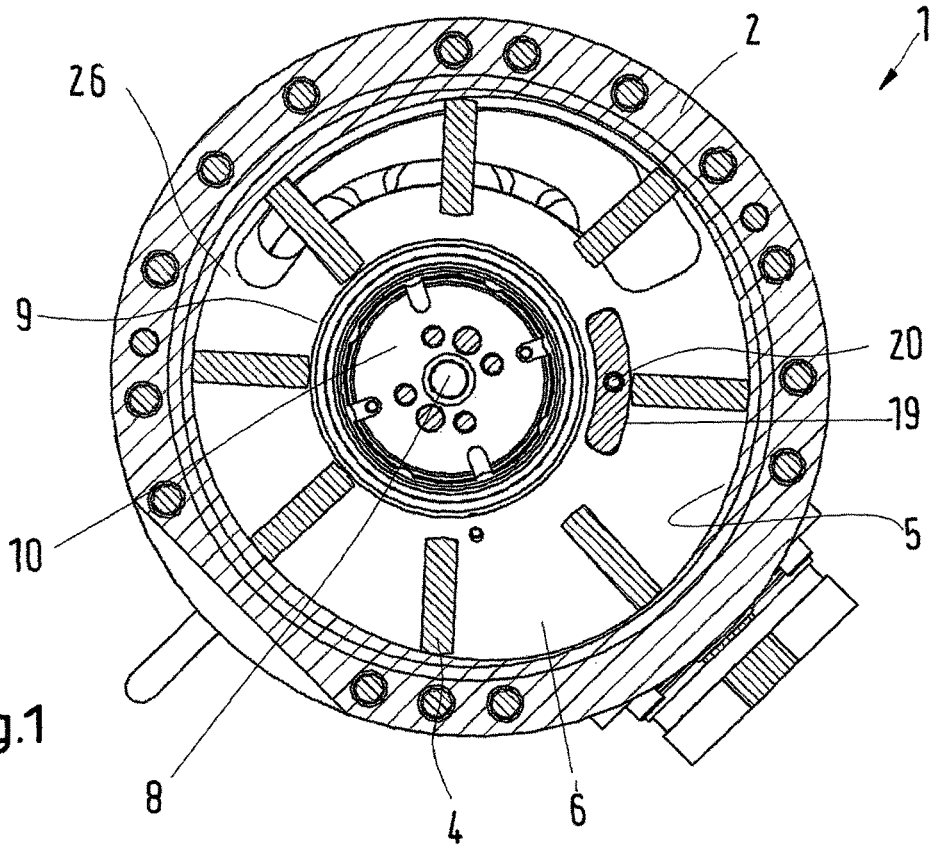
FIG. 1 is a schematic illustration of a cross-section of a vane cell machine and FIG. 2 is an enlarged section of an axial end part of a rotor of the vane cell machine.
Figure 2:
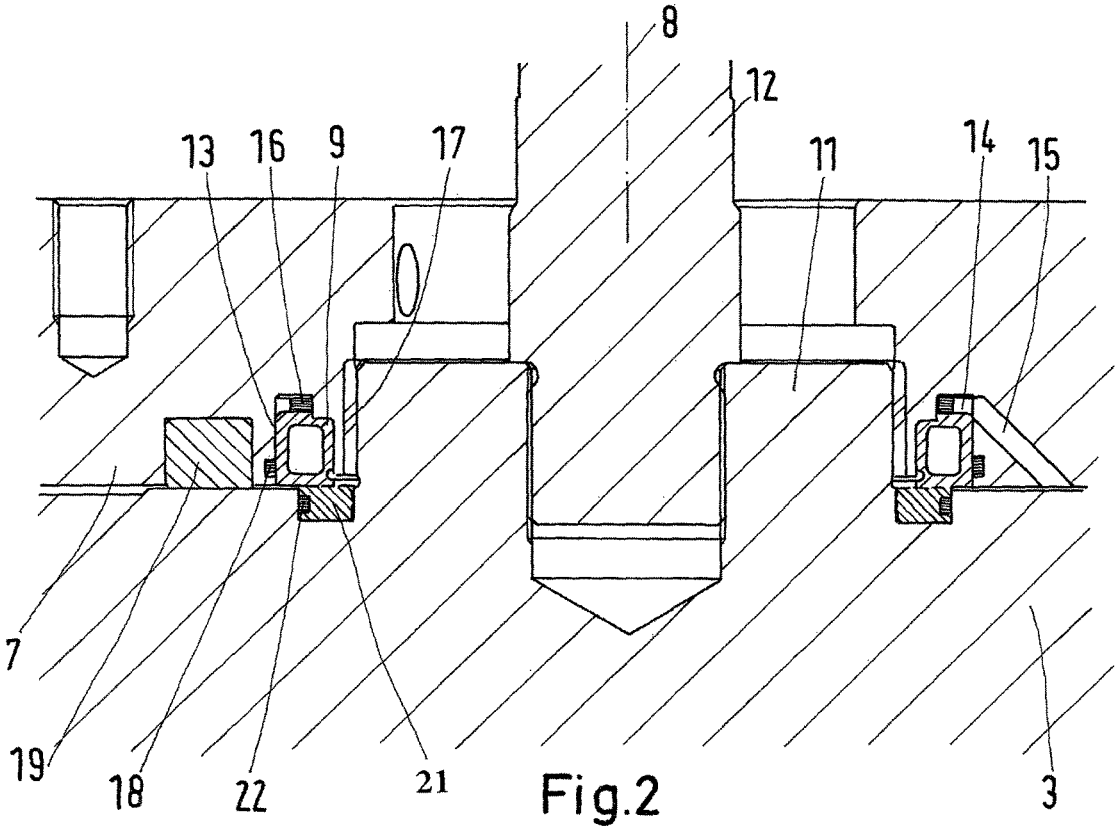

FIG. 1 shows schematically a vane cell machine 1 comprising a stator 2 and a rotor 3. The rotor 3 comprises a number of vanes 4, which are radially displaceable and bear on an inside 5 of the stator. Between each of two neighboring vanes 4 a work chamber 6 is positioned. At both axial ends the work chambers 6 are limited by a side wall 7 (FIG. 2).

During a rotation of rotor 3 relative to stator 2 around an axis 8, the work chambers 6 increase and decrease their volume. During the increase of volume hydraulic fluid is sucked and during decrease of the volume of the work chambers 6 hydraulic fluid is pressurized and finally outputted under a higher pressure. The respective port for supply and delivery of the hydraulic fluid are not shown for sake of clarity.

As can be seen in FIG. 1, the rotor 3 is placed eccentrically within stator 2.

Side wall 7 accommodates an insert in form of a ring 9. Ring 9 comprises a centric bore 10. Rotor 3 comprises an axle 11 connected to a shaft 12. Ring 9 surrounds axle 11.

Ring 9 is located in a groove 13 within side wall 7 and protrudes a bit out of side wall 7 in a direction towards rotor 3, e.g. by 0.5 mm.

On a side of ring 9 opposite to rotor 3, there is a ring channel 14 which is connected by means of a bore 15 to a region 26 in which said work chambers 6 show a high pressure. This means that the ring channel 14 is loaded with this high pressure. This high pressure is used to press ring 9 towards rotor 3.

Rotor 3 bears a support ring 21 contacting ring 9. One of ring 9 and support ring 21 can be used as a wear part which can easily be replaced if worn or necessary, because of other reasons.

A first sealing ring 16 is positioned on the side of ring 9 opposite to rotor 3. The first sealing ring 16 seals the high pressure against a leakage in a direction towards a radial bearing 17 with which axle 11 is supported inside wall 7.

A second sealing ring 18 is placed on a circumferential side of ring 9. The second sealing ring 18 is positioned as close as possible to rotor 3 so that most of the axial length of ring 9 is subjected to the high pressure acting radially inwardly.

The first sealing ring 16 and the second sealing ring 18 are both made of an elastic material. Both sealing rings 16, 18 therefore generate a sort of pretension. Sealing ring 16 presses ring 9 against rotor 3 or more precisely against support ring 21 of rotor 3. Second sealing ring 18 centers ring 9 in the side wall 7.

In addition to the first sealing ring 16, a spring or any other force generating means can be used to press ring 9 towards rotor 3.

As mentioned above, rotor 3 is located eccentrically within the inside 5 of stator 2.

In order to support the rotor 3 in a region in which the distance between the rotor 3 and the inside 5 of the stator 2 is largest, an auxiliary element 19 is provided, which is fixed to the side wall 7, for example, by one or two screws 20. The auxiliary element 19 is slightly curved. An inner radius of the auxiliary element 19 is slightly larger than an outer radius of ring 9. A radially outer side of auxiliary element 19 runs essentially parallel to the radially inner side of auxiliary element 19.

The auxiliary element 19 can have a decreasing width in radial direction, i.e. it can have the form of a sickle or of a crescent moon (not shown). In any case, the auxiliary element 19 should extend in circumferential direction not more than over 180°. In this case the ends in circumferential direction have a width tending against zero. Basically, it is sufficient when the auxiliary element 19 extends in circumferential direction at least over the width of the vane 4 in circumferential direction and preferably it should extend at least over a distance between two vanes 4 in circumferential direction.

As can be seen in FIG. 2, the auxiliary element 19 protrudes out of side wall 7. The auxiliary element must protrude far enough that the rotor 3 cannot touch the side wall 7 and so that the ring 9 cannot get pinched inside the groove 13. It is sufficient when ring 9 and auxiliary element 19 protrude by 0.5 mm out of side wall 7.

As can be seen in FIG. 2, there is a radial distance between ring 9 and auxiliary element 19. This distance makes it possible to accommodate second sealing ring 18. The sealing ring 18 can also be accommodated in the ring 9.

The vane cell machine 1 can, for example, be used as a booster pump or circulation pump in a combination of pressure exchanger and booster pump, which can be used, for example, in a reverse osmosis system. In this case, there is always a rather high pressure within the vane cell machine. The booster pump sucks liquid at a pressure of for example 57 bar and outputs liquid with a pressure of 60 bar. The shaft 12 is usually sealed with a low pressure sealing only. Therefore, in the machine described sealing is achieved by the sealing ring 16 and, if necessary, by a third sealing ring 22 surrounding the support ring 21.

The new ring 9, which is symmetric in all angular directions and comprises a centric bore 10, now is the only element which is necessary for the sealing function. The auxiliary element 19 serves as axial bearing and as blocking means against leakages.

The machine 1 shown is simple in construction and can therefore be simply mounted.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A vane cell pump comprising:

a stator; and a rotor;

wherein said rotor having radially displaceable vanes bearing on an inside of the stator and bordering, together with the rotor, the stator, and a side wall at each axial end of the rotor, at least one side wall bearing an insert in form of a ring; and wherein said ring comprises a centric bore;

wherein an auxiliary element is located radially outside said ring and extends no more than 180° in circumferential direction of said ring; and wherein the auxiliary element is arranged between the at least one side wall bearing the insert and the rotor, the auxiliary element being fixed to the at least one side wall bearing the insert.

2. The vane cell pump according to claim 1, wherein said auxiliary element comprises a width in radial direction of said rotor decreasing in circumferential direction starting from a central part.

3. The vane cell pump according to claim 2, wherein said auxiliary element has a length in circumferential direction which is greater than a width of said vanes in circumferential direction.

4. The vane cell pump according to claim 2, wherein said auxiliary element has a length in circumferential direction which is greater than a distance between two vanes in circumferential direction.

5. The vane cell pump according to claim 2, wherein in radial direction said auxiliary element has a predetermined distance to said ring.

6. The vane cell pump according to claim 2, wherein said auxiliary element protrudes out of said at least one side wall.

7. The vane cell pump according to claim 1, wherein said auxiliary element has a length in circumferential direction which is greater than a width of said vanes in circumferential direction.

8. The vane cell pump according to claim 7, wherein said auxiliary element has a length in circumferential direction which is greater than a distance between two vanes in circumferential direction.

9. The vane cell pump according to claim 7, wherein in radial direction said auxiliary element has a predetermined distance to said ring.

10. The vane cell pump according to claim 7, wherein said auxiliary element protrudes out of said at least one side wall.

11. The vane cell pump according to claim 1, wherein said auxiliary element has a length in circumferential direction which is greater than a distance between two vanes in circumferential direction.

12. The vane cell pump according to claim 11, wherein in radial direction said auxiliary element has a predetermined distance to said ring.

13. The vane cell pump according to claim 1, wherein in radial direction said auxiliary element has a predetermined distance to said ring.

14. The vane cell pump according to claim 1, wherein said auxiliary element protrudes out of said at least one side wall.

15. The vane cell pump according to claim 1, wherein a ring channel is located on a side of said ring opposite said rotor, said ring channel being connected to a high pressure region of the vane cell pump.

16. The vane cell pump according to claim 15, wherein a first sealing ring is located in said ring channel, wherein said first sealing ring generates a force onto said ring in a direction towards said rotor.

17. The vane cell pump according to claim 15, wherein a second sealing ring is positioned on a circumferential side of said ring.

18. The vane cell pump according to claim 1, wherein said rotor comprises a support ring bearing against said ring.

19. The vane cell pump according to claim 1, wherein the auxiliary element is in contact with the at least one side wall bearing the insert and the rotor.

* * * * *